US005274885A

United States Patent [19]

Hellweg

[11] Patent Number: 5,274,885

[45] Date of Patent: Jan. 4, 1994

[54] ATTACHMENT CLIP

[75] Inventor: Albert W. Hellweg, Vermont, Australia

[73] Assignee: Hellweg Innovation Pty Ltd., Victoria, Australia

[21] Appl. No.: 46,667

[22] Filed: Apr. 14, 1993

[30] Foreign Application Priority Data

Apr. 14, 1992 [AU] Australia ..... PL1875

[51] Int. Cl.[5] ..... A45F 5/00

[52] U.S. Cl. ..... 24/3 R; 24/3 F; 24/597; 224/272

[58] Field of Search ..... 24/3; 224/197, 272, 224/252

[56] References Cited

U.S. PATENT DOCUMENTS 4,419,794 12/1983 Horton, Jr. et al. ..... 224/272
4,718,586 1/1988 Hagino ..... 224/252
5,054,170 10/1991 Otrusina ..... 24/3 R

*Primary Examiner*—Victor N. Sakran
*Attorney, Agent, or Firm*—Renner, Otto, Boisselle & Sklar

[57] ABSTRACT

An attachment clip with a body having a rear member and a front member co-operating with the rear member to define an enclosed volume, a retaining member in the enclosed volume and having members projecting from the enclosed volume to enable the retaining member to be moved between first and second positions; the front member having an opening therethrough to allow a lug to be able to be held by the retaining member when in the second position.

8 Claims, 2 Drawing Sheets

ATTACHMENT CLIP

This invention relates to an attachment clip and refers specifically, though not exclusively, to an attachment clip to enable devices such as portable radios and the like to be attached in a secure but releasable manner to a belt or the like.

Throughout this specification reference to "radio" is to be taken in a non-limiting sense. It is to include reference to any device which may be desired to be securely though releasably attached to another article. This may include portable telephones, portable radios, two-way radios, portable tape recorders, portable compact disc players, holsters, scabbards, truncheons, or any other suitable or similar device. The article to which it may be attached may include a belt, dashboard, door, console or other suitable flat or approximately flat surface or article including belts worn by persons, or flat surfaces of motor cycles, bicycles, cars, trucks, walls, or the like.

There has been a significant problem for some time by those having to carry two-way radios or portable telephones that when they are not in use they must be stored in some suitable way. Previously, this was by a clip attached to the back of the radio and adapted to be placed in a corresponding opening of a receptor on a belt worn by the person concerned. These have experienced problems that when the person is running or moving in any reasonably quick manner the radio could come loose from the belt and fall. This can cause significant damage. Given the cost of such appliances this is to be avoided if possible.

It is therefore the principal object of the present invention to provide an attachment clip whereby a radio (as hereinbefore defined) can be securely though releasably attached to a belt (as hereinbefore defined).

With the above and other objects in mind, the present invention provides an attachment clip comprising a body having a rear member and a front member cooperating with said rear member to define an enclosed volume, a retaining member in said enclosed volume and having at least one operating member projecting from said enclosed volume to enable said retaining member to be moved between first and second positions; said front member having an opening therethrough to, in use, receive therethrough a lug of a shape related to the shape of said opening, said lug being attached to a radio (as hereinbefore defined), said lug being engaged by said retaining member to prevent removal thereof when said retaining member is in said second position, said lug being insertable and removable when said retaining member is in said first position.

In order that the invention may be fully understood there shall now be described by way of non-limitative example only a preferred embodiment of a retaining clip with reference to the accompanying illustrative drawings, in which.

Figure 1:
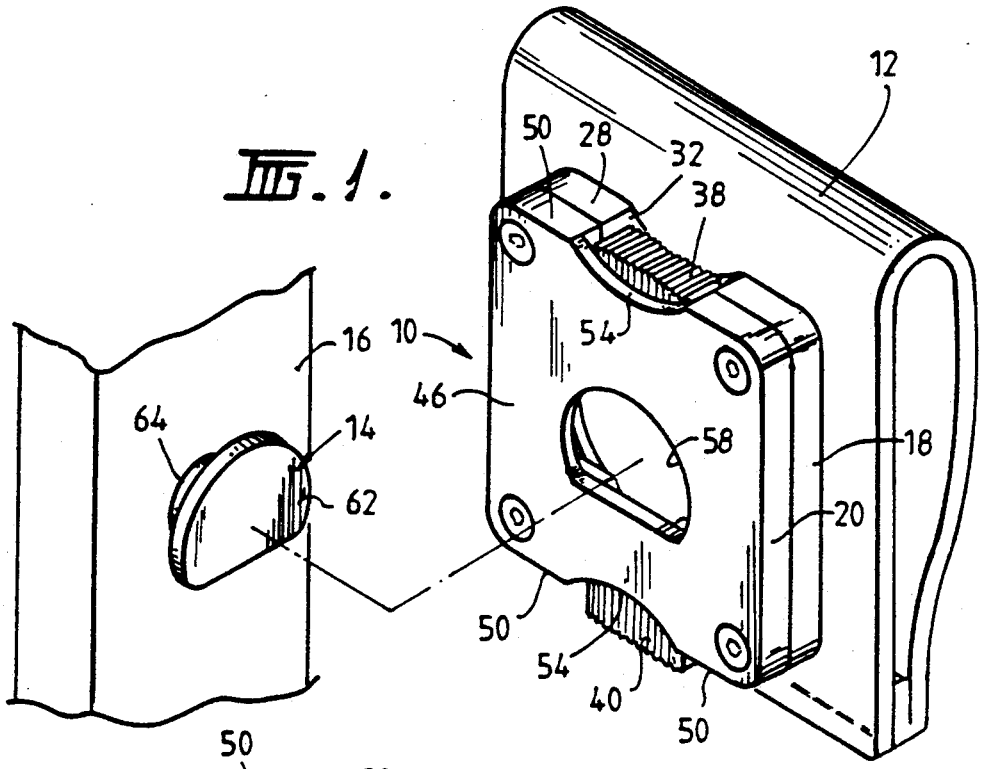
FIG. 1 is a perspective view of the retaining clip as fitted to a belt (as hereinbefore defined) and adapted to receive a lug attached to a radio (as hereinbefore defined)
Figure 2:
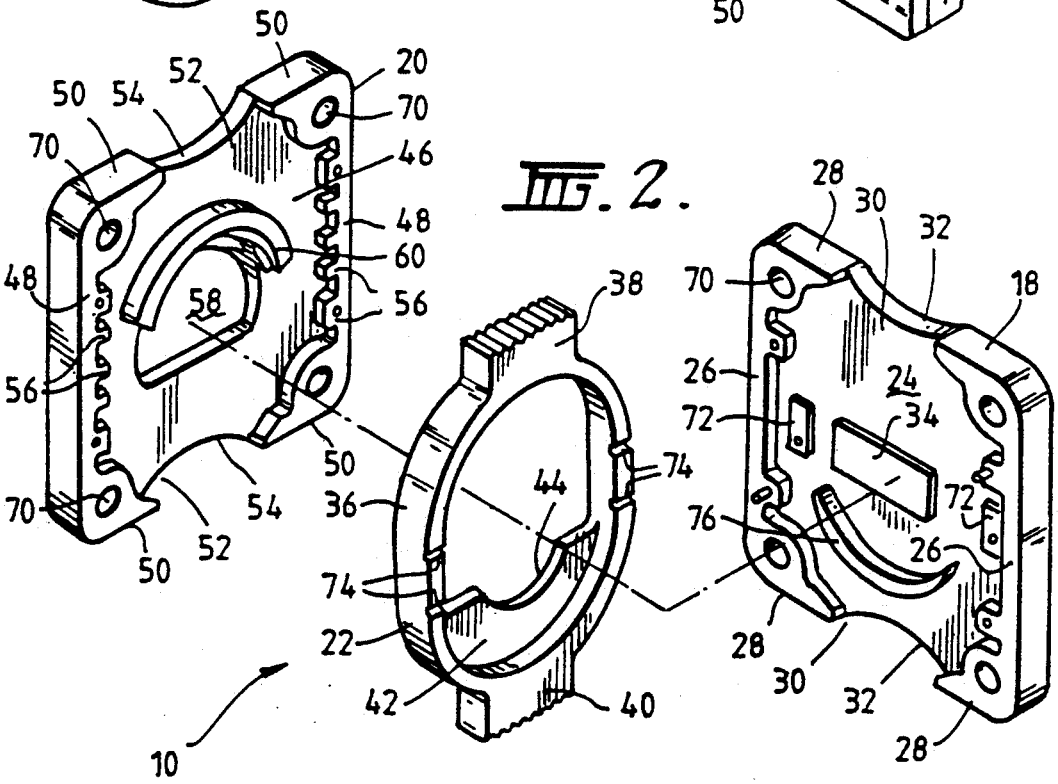
FIG. 2 is an exploded perspective view of the retaining clip of FIG. 1.

The attachment clip illustrated is generally designated as 10. This clip is for attachment to a belt (as hereinbefore defined) 12 and is adapted to receive in a secure though releasable manner a lug 14 attached to a radio (as hereinbefore defined) 16.

The attachment clip comprises a rear member 18, a front member 20 and a retaining member 22.

The rear member 18 has a generally planar rear panel 24, side walls 26 projecting forwardly therefrom, and end walls 28. The end walls 28 are not continuous in that there is a central opening 30 therein which corresponds to a concave portion 32 of the rear panel 24. A pad 34 is approximately centrally located on the rear panel 24. The purpose of this pad 34 will be explained in the following description.

The retaining member 22 is approximately ovular in shape and has a peripheral wall 36 with there being an upper operating member 38 and a lower operating member 40. Within the wall 36 and adjacent the lower operating member 40 is an arcuate member 42 having a concave depression 44.

The front member 20 has a front panel 46, side walls 48, and end walls 50. The side walls 48 and end walls 50 correspond in extent, shape and dimensions to the side walls 26 and end walls 28. A gap 52 is also provided of the same extent as the gap 30 and a concave cut-out 54 is also provided on front panel 46 in the same way as the concave cut-out 32 on rear panel 24.

Projecting inwardly from the side walls 48 are a plurality of lugs 56 which serve to reasonably accurately locate the retaining member 22 when the retaining clip 10 is fully assembled.

Approximately centrally located in the front panel 46 is an opening 58 of shape related to the shape of the lug 14. Above the opening 58 is an arcuate lug 60. The radius of curvature of the arcuate lug 60 is very similar to the radius of curvature of the wall 36 of retaining member 22.

The lug 14 has a head 62 which is shaped as a segment of a circle. It is attached to a stem 64. The stem connects the head 62 to the radio 16. The stem 64 has a flattened portion 66 which is aligned and corresponds to the flattened portion 68 of the head 62.

In use, the retaining clip 10 is assembled as is clear from FIG. 1. The rear member 18 and front member 20 may be secured together by screws, rivets, bolts, welding, gluing or the like. Four corner holes 70 may be provided to enable the retaining clip to be secured to the belt 12. Any suitable attachment means may be used.

Once in position, the retaining clip can receive the lug 14 through the opening 58. In this position, it is clear that the radio 16 could easily be removed by any movement of the wearer. Therefore, the radio 16, and thus the lug 14, is rotated through 180°. Due to the presence of the arcuate lug 60, and the shape of the flat portion 68 of head 62, once rotated, the arcuate portion of head 62 locates to the rear of the front 46 immediately below the opening 58. This prevents the normal removal of the lug 14 through the opening 58. However, it does not prevent rotation of the radio 16 and thus the lug 14. It has been found that through normal vibration they can rotate again through 180° and then fall out.

Figure 3:
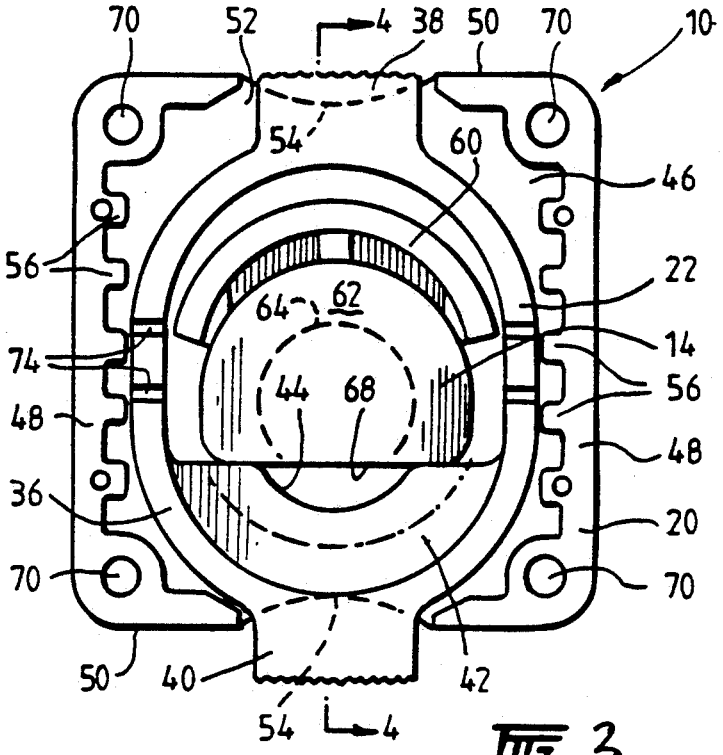
FIG. 3 is a front view of the retaining clip of FIGS. 1 and 2, the front cover having been removed, with the retaining member being in the first position.
Figure 4:
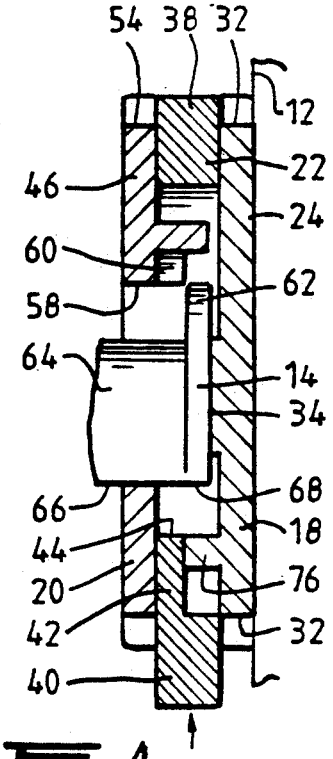
FIG. 4 is a vertical cross-sectional view along the lines and in the direction of arrows 4—4 of FIG. 3.
Figure 5:
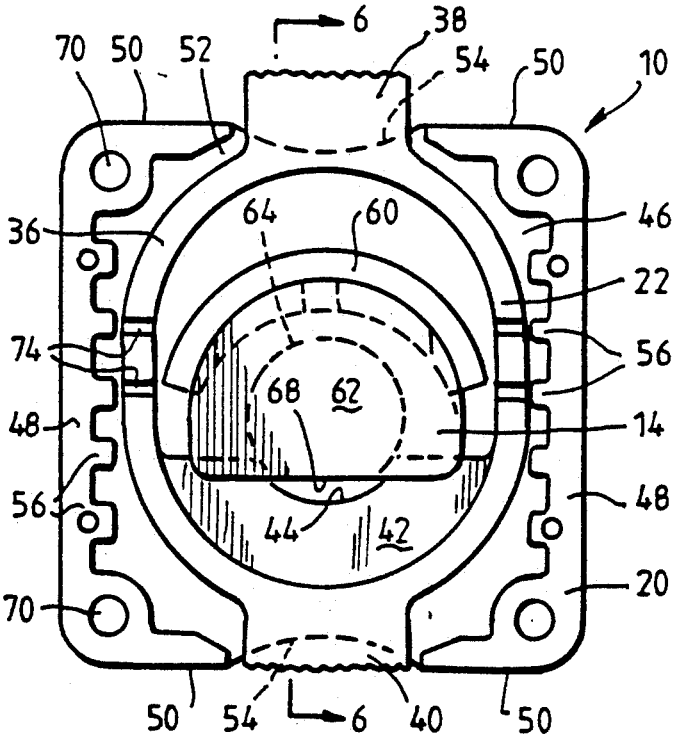
FIG. 5 is a view corresponding to that of FIG. 3 with the retaining member in the second position.
Figure 6:
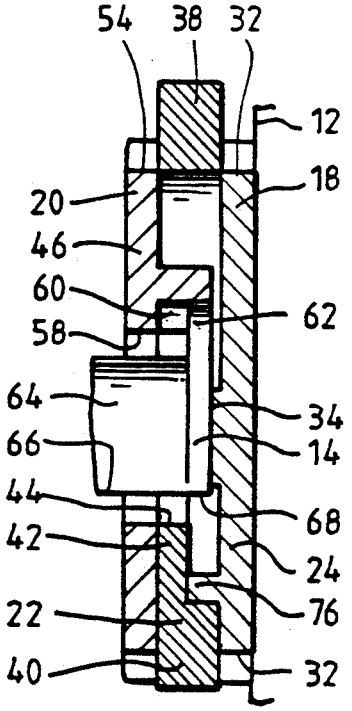
FIG. 6 is a vertical cross-sectional view along the lines and in the direction of arrows 6—6 of FIG. 5.

Therefore, the retaining member 22 is moved from the first position as shown in FIGS. 3 and 4 by finger pressure on the lower operating member 40 and directed upwardly (see FIG. 4) to move the retaining member 22 to the second position as shown in FIGS. 5 and 6. When in this position, the arcuate member 42 engages under the head 62 of lug 14 and, to a certain extent, against the stem 64 of lug 14. When in this position, no matter the rotation of the radio 16 and thus the lug 14, the lug 14 cannot be removed through the opening 58. In other words, the radio can be rotated through 360° and there can be no removal.

To remove the lug 14 and thus the radio 16, the retaining member 22 is returned to the first position (FIGS. 3 and 4) by means of a downward pressure on the upper operating member 38. It can then easily be removed with or without rotation depending on the rotational position of the radio 16 and thus lug 14.

If desired, the front 46 may have small projections either side of the opening 48 to engage in corresponding small grooves in wall 36 of retaining member 22 so as to provide a method of locating the first and second positions of the retaining member 22. In addition, or as an alternative, the back 24 may be provided with two small projections 72 which can cooperate with two small grooves 74 in the wall 36 of retaining member 22 to accomplish the same task.

The pad 34 is provided on the back 24 so as to ensure the movement of the lug 14 in the axial direction is not excessive. This may be deleted, if required.

As can be understood from the foregoing description, the retaining clip of the present invention is very easily manufactured and assembled and provides a method of securely though releasably retaining a device such as a radio (as hereinbefore defined) in the clip which can be attached to a belt (as hereinbefore defined).

Whilst there has been described in the foregoing description a preferred embodiment of a retaining clip incorporating the principal features of the present invention, it will be understood by those in the technical field concerned that many variations or modifications in details of design or construction may be made without departing from the ambit of the present invention.

One such modification is the fitment of a second arcuate lug 74 to the back 24 so as to provide for further locating and more accurate locating of the head 62 of lug 14 when inserted. It would also assist in accurate locating of the retaining member 22 and to prevent unnecessary or unwanted movement in the direction of the axis of the lug 14.

I claim:

1. An attachment clip comprising a body having a rear member and a front member cooperating with said rear member to define an enclosed volume, a retaining member in said enclosed volume and having at least one operating member projecting from said enclosed volume to enable said retaining member to be moved between first and second positions; said front member having an opening therethrough to, in use, receive therethrough a lug of a shape related to the shape of said opening, said lug being attached to a portable article, said lug being engaged by said retaining member to prevent removal thereof when said retaining member is in said second position, said lug being insertable and removable when said retaining member is in said first position.

2. An attachment clip as claimed in claim 1, wherein said retaining member has a peripheral wall, an upper operating member and a lower operating member.

3. An attachment clip as claimed in claim 2, wherein within said peripheral wall and adjacent said lower operating member there is provided an arcuate member.

4. An attachment clip as claimed in claim 3, wherein said arcuate member has a concave depression.

5. An attachment clip as claimed in claim 1, wherein said front member has a front panel, side walls and end walls projecting rearwardly from said front panel; said end walls having centrally located gaps therethrough, said front panel having a concave cut-out located correspondingly to one of said gaps.

6. An attachment clip as claimed in claim 5, wherein said front panel has said opening therethrough, there being provided an arcuate lug on the inner surface of said front panel over and adjacent to said opening.

7. An attachment clip as claimed in claim 1, wherein said rear member has a generally planar rear panel and side walls and end walls projecting forwardly from said rear panel; said end walls having centrally located gaps therethrough, said rear panel having a concave cut-out located correspondingly to one of said gaps.

8. An attachment clip as claimed in claim 7, wherein said rear panel has a centrally located pad attached to the inner surface thereof.

* * * * *